US007451903B2

(12) United States Patent
Aihara

(10) Patent No.: US 7,451,903 B2
(45) Date of Patent: Nov. 18, 2008

(54) MAIN VALVE MECHANISM OF COMPRESSED AIR NAILING MACHINE

(75) Inventor: Yasunori Aihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 11/660,220

(22) PCT Filed: Aug. 15, 2005

(86) PCT No.: PCT/JP2005/014912

§ 371 (c)(1),
(2), (4) Date: Jun. 21, 2007

(87) PCT Pub. No.: WO2006/019075

PCT Pub. Date: Feb. 23, 2006

(65) Prior Publication Data

US 2008/0023519 A1 Jan. 31, 2008

(30) Foreign Application Priority Data

Aug. 19, 2004 (JP) ..... 2004-239893

(51) Int. Cl.
*B25C 1/04* (2006.01)

(52) U.S. Cl. ..... 227/130; 227/8

(58) Field of Classification Search ..... 227/8, 227/10, 130; 123/46 SC; 91/422, 426
See application file for complete search history.

(56) References Cited

U.S. PATENT DOCUMENTS 4,667,572 A * 5/1987 Elliesen ..... 91/461
4,784,308 A * 11/1988 Novak et al. ..... 227/130
4,867,366 A * 9/1989 Kleinholz ..... 227/66
5,131,579 A * 7/1992 Okushima et al. ..... 227/8
5,259,465 A * 11/1993 Mukoyama ..... 173/168
5,476,205 A * 12/1995 Canlas et al. ..... 227/130

(Continued)

FOREIGN PATENT DOCUMENTS

JP U-3-55174 5/1991

(Continued)

*Primary Examiner*—Scott A. Smith
(74) *Attorney, Agent, or Firm*—Morgan, Lewis & Bockius LLP

(57) ABSTRACT

An air intake valve seat 24 is formed by mounting a cylinder seal 29 of rubber or the like from an upper face of a ring-shaped flange portion 28 formed to project from an outer peripheral face of a strike cylinder 15 over to an upper end portion of the strike cylinder 15 to cover surfaces thereof. A main valve 21 in a ring shape is arranged along an outer periphery of the strike cylinder 15 on an upper side of a ring-shaped flange portion 28. An outer peripheral edge portion 30 of a piston stop 18 of rubber or the like arranged on an upper side of the strike cylinder 15 is arranged to extend in a lower direction from an upper end portion along an outer peripheral face of the strike cylinder 15 to thereby form an air exhaust valve seat 25 at a lower end of the outer peripheral edge portion 30. In addition, an air intake/exhaust path 32 for guiding compressed air from the main valve 21 to an upper end edge of the strike cylinder 15 is formed between an outer peripheral face of the cylinder seal 29 and an inner peripheral face of the outer peripheral edge portion 30 of the piston stop 19.

3 Claims, 4 Drawing Sheets

U.S. PATENT DOCUMENTS

| | | | | | |
|---|---|---|---|---|---|
| 5,732,870 | A * | 3/1998 | Moorman et al. | 227/130 |
| 5,829,660 | A * | 11/1998 | White | 227/8 |
| 5,878,936 | A * | 3/1999 | Adachi et al. | 227/130 |
| 6,024,269 | A * | 2/2000 | Ho et al. | 227/130 |
| 6,039,231 | A * | 3/2000 | White | 227/130 |
| 6,626,081 | B2 * | 9/2003 | Ho et al. | 91/394 |
| 6,779,699 | B2 * | 8/2004 | Aoki et al. | 227/130 |
| 6,854,631 | B2 * | 2/2005 | Burke et al. | 227/130 |
| 7,293,684 | B1 * | 11/2007 | Wen | 227/130 |
| 7,325,710 | B1 * | 2/2008 | Wen | 227/130 |
| 7,377,413 | B2 * | 5/2008 | Wen | 227/8 |

FOREIGN PATENT DOCUMENTS

| | | |
|---|---|---|
| JP | U-5-2877 | 1/1993 |
| JP | Y-06-045336 | 11/1994 |
| JP | 8-336768 | 12/1996 |
| JP | 2001-105348 | 4/2001 |

* cited by examiner

MAIN VALVE MECHANISM OF COMPRESSED AIR NAILING MACHINE

TECHNICAL FIELD

The present invention relates to a compressed air nailing machine for driving a strike piston slidably contained at inside of a strike cylinder by compressed air and striking a nail by a driver integrally coupled with the strike piston to be struck to a struck member. Particularly, the invention relates to a main valve mechanism of a compressed air nailing machine for supplying compressed air for driving the strike piston to inside of the strike cylinder and exhausting compressed air from inside of the strike cylinder after driving the strike piston.

BACKGROUND ART

Generally, in a nailing machine constituting a power source by compressed air, a strike piston integrally connected with a driver for striking a nail is arranged by being contained slidably at inside of a strike cylinder, by supplying compressed air stored at inside of an air chamber connected to a compressed air supply source to inside of the strike cylinder, the strike piston is impulsively driven at inside of the strike cylinder, and a nail is struck by a driver connected to the strike piston. In addition, in order to supply compressed air for driving the strike piston to inside of the strike cylinder and exhaust compressed air after driving the strike piston from inside of the strike cylinder, an upper end portion of the strike cylinder is provided with a main valve for selectively connecting inside of the strike cylinder to the air chamber and an exhaust port connected to the atmosphere.

Normally, such a main valve is constituted as a head valve arranged on an upper side of the strike cylinder, a lower end face of the head valve is brought into close contact with an upper end face of the strike cylinder to thereby close an interval between inside of the strike cylinder and the air chamber. Compressed air is supplied to inside of the strike cylinder by communicating the interval between the air chamber and the strike cylinder by separating the lower end face of the head valve from the upper end face of the strike cylinder by operating the head valve to an upper side. Therefore, the head valve is arranged at a position on an upper side of an upper end of the strike cylinder as a whole, and a dimension capable of moving the head valve to the upper side is needed.

When the head valve is arranged at the position upward from the upper end of the strike cylinder as described above, a total height of the nailing machine needs to be formed to be large by an amount of a dimension of the head valve and a dimension of operating the head valve to the upper side. For example, when one wall frame is connected to other wall frame by a nail in 2×4 construction method or the like, as in a case of connecting the one wall frame to a floor by a nail, there is a case in which the nailing machine cannot be used at a narrow place restricting the total height of the nailing machine as in connecting one wall frame to a floor by a nail.

JP-Y-06-045336 discloses a nailing machine in which a total height of the nailing machine is reduced by reducing a dimension upward from a strike cylinder by arranging a main valve mechanism at a surrounding of an upper end portion of the strike cylinder in order to prevent the total height of the nailing machine from being increased as described above. According to the nailing machine, there is constructed a constitution in which the main valve is formed in a ring shape to be able to slide along an outer peripheral face of the strike cylinder, an outer peripheral face remote from an upper end of the strike cylinder to a lower side is formed with a valve seat for supplying air and a valve seat for exhausting air to be opposed to the valve seat for supplying air at a predetermined interval therebetween, a valve member portion for supplying and exhausting air in a ring shape formed at the main valve is arranged between the valve seat for supplying air and the valve seat for exhausting air, and the valve member portion for supplying and exhausting air of the main valve is made to seal selectively the valve seat for supplying air and the valve seat for exhausting air by a face thereof.

According to the nailing machine of JP-Y-06-045336, a ring-shaped member in a sleeve-like shape is arranged at an outer periphery of the strike cylinder by maintaining a predetermined interval from a side of the outer peripheral face of the strike cylinder to thereby form an intake/exhaust path for guiding compressed air to inside of the strike cylinder by an inner peripheral face of the ring-shaped member and the outer peripheral face of the strike cylinder. Moreover, a lower end face of the ring-shaped member is mounted with a seal member made of rubber for forming the valve seat for exhausting air engaged with the valve member portion for supplying and exhausting air of the main valve.

Meanwhile, there is a nailing machine of a recent time using compressed air in a high pressure region higher than a normal pressure lower than 10 kg/cm$^2$ in the pressure of the compressed air as a power source. According to the nailing machine used by compressed air at such a high pressure, there is a case in which high pressure compressed air supplied from a compressed air supply source at high pressure to inside of an air chamber of a nailing machine is expanded at inside of the air chamber, water included in compressed air is frozen by a temperature drop by the adiabatic expansion and small ice particles are produced at inside of compressed air in the air chamber. The ice particles included in compressed air are adhered to the inner peripheral face of the ring-shaped member and the outer peripheral face of the strike cylinder when compressed air flows to inside of the strike cylinder by opening the head valve, the ice particles gradually grow to be large and deposited on seal faces of the valve seat for sucking air and the valve seat for exhausting air and the head valve is failed to be operated by a failure in seal or leakage of air.

DISCLOSURE OF THE INVENTION

According to one or more embodiments of the invention, there is provided a main valve mechanism of a compressed air nailing machine capable of lowering a total height of the nailing machine and preventing an operational failure by freezing from being brought about even when the main valve mechanism is operated by compressed air at high pressure.

According to one or more embodiments of the invention, the nailing machine is provided with a strike piston, a strike cylinder for slidably containing the strike piston, an air chamber storing compressed air, a ring-shaped flange portion formed to project from an outer peripheral face remote from an upper end edge of the strike cylinder, a main valve formed in a ring shape and slidably arranged on an upper side of the ring-shaped flange portion, a cylinder seal for covering surfaces of an upper face of the ring-shaped flange portion and an upper end portion of the strike cylinder from an upper face of the ring-shaped flange portion over to an upper end portion of the strike cylinder, a piston stop including an outer peripheral edge portion arranged on an upper side of the strike cylinder, damping the strike piston at an upper dead center position and formed to extend in a lower direction along an outer peripheral face of an upper portion of the strike cylinder, an air intake valve seat formed at a position of the cylinder seal opposed to a lower end of the main valve, an air exhaust valve seat formed at a lower end of the outer peripheral edge portion of the piston stop, and an air intake/exhaust path formed between an outer peripheral face of the cylinder seal and an inner peripheral face of the outer peripheral edge portion of the piston stop for guiding compressed air from the main valve to an upper end edge of the strike cylinder.

According to one or more embodiments of the invention, the cylinder seal and the piston stop are formed by a material having a heat insulating property larger than a heat insulating property of a material constituting the strike cylinder and having an elasticity higher than an elasticity of the material of constituting the strike cylinder.

According to one or more embodiments of the invention, the cylinder seal and the piston stop are formed by an elastomer.

Other aspects and advantages of the invention will be apparent from the following description and the appended claims.

DESCRIPTION OF REFERENCE NUMERALS AND SIGNS

Figure 1:
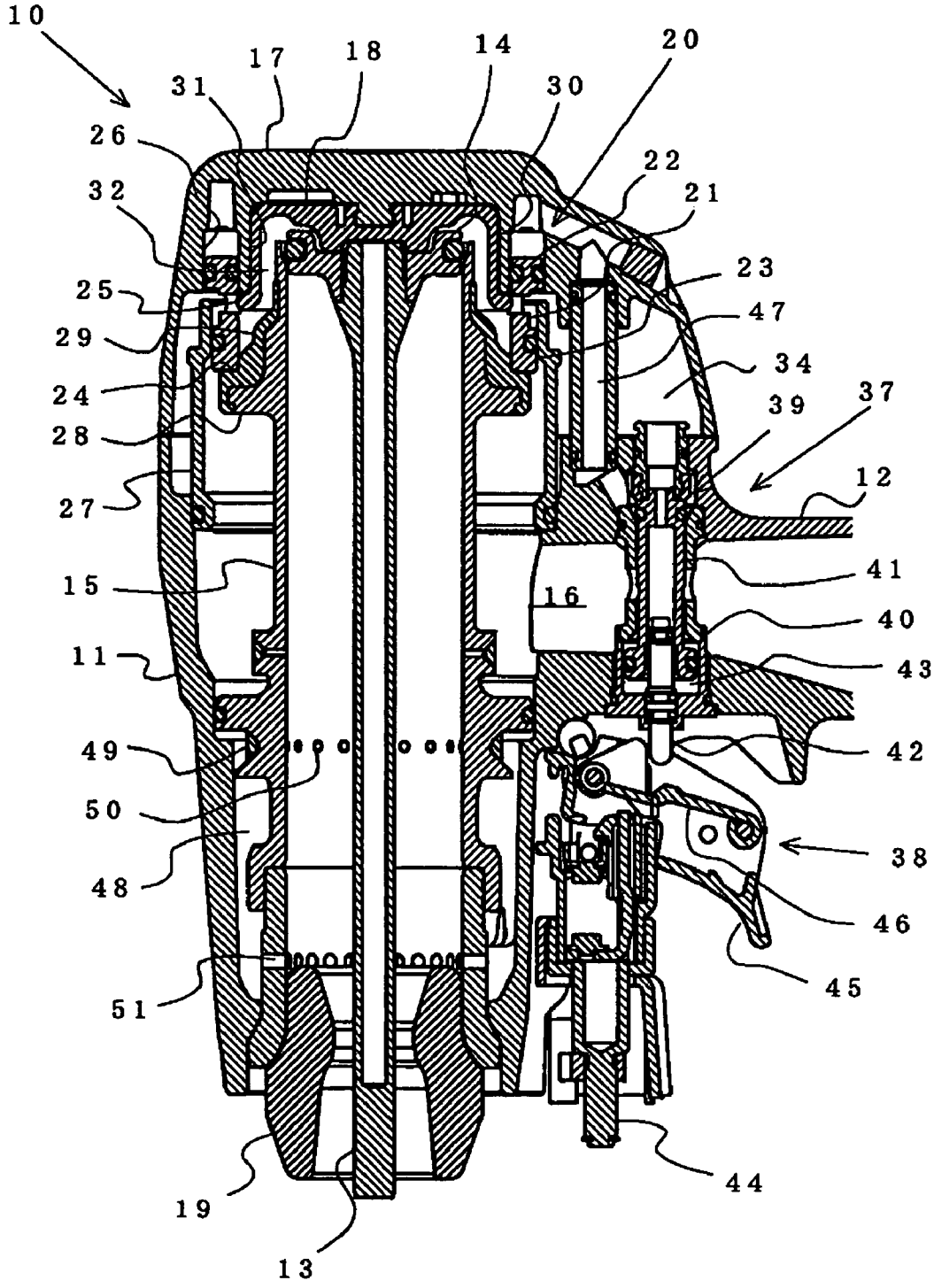
FIG. 1 is a vertical sectional side view showing a compressed air nailing machine.

10 . . . nailing machine
13 . . . driver
14 . . . strike piston
15 . . . strike cylinder
16 . . . air chamber
18 . . . piston stop
20 . . . main valve mechanism
21 . . . main valve
22 . . . ring-shaped piston portion
23 . . . ring-shaped valve member portion
24 . . . valve seat for supplying air
25 . . . valve seat for exhausting air
26 . . . ring-shaped recess portion (control chamber)
28 . . . ring-shaped flange portion
29 . . . cylinder seal
30 . . . outer peripheral edge portion
32 . . . intake/exhaust path

BEST MODE FOR CARRYING OUT THE INVENTION

Embodiments of the invention will be explained in reference to the drawings as follows.

EMBODIMENT 1

Figure 2:
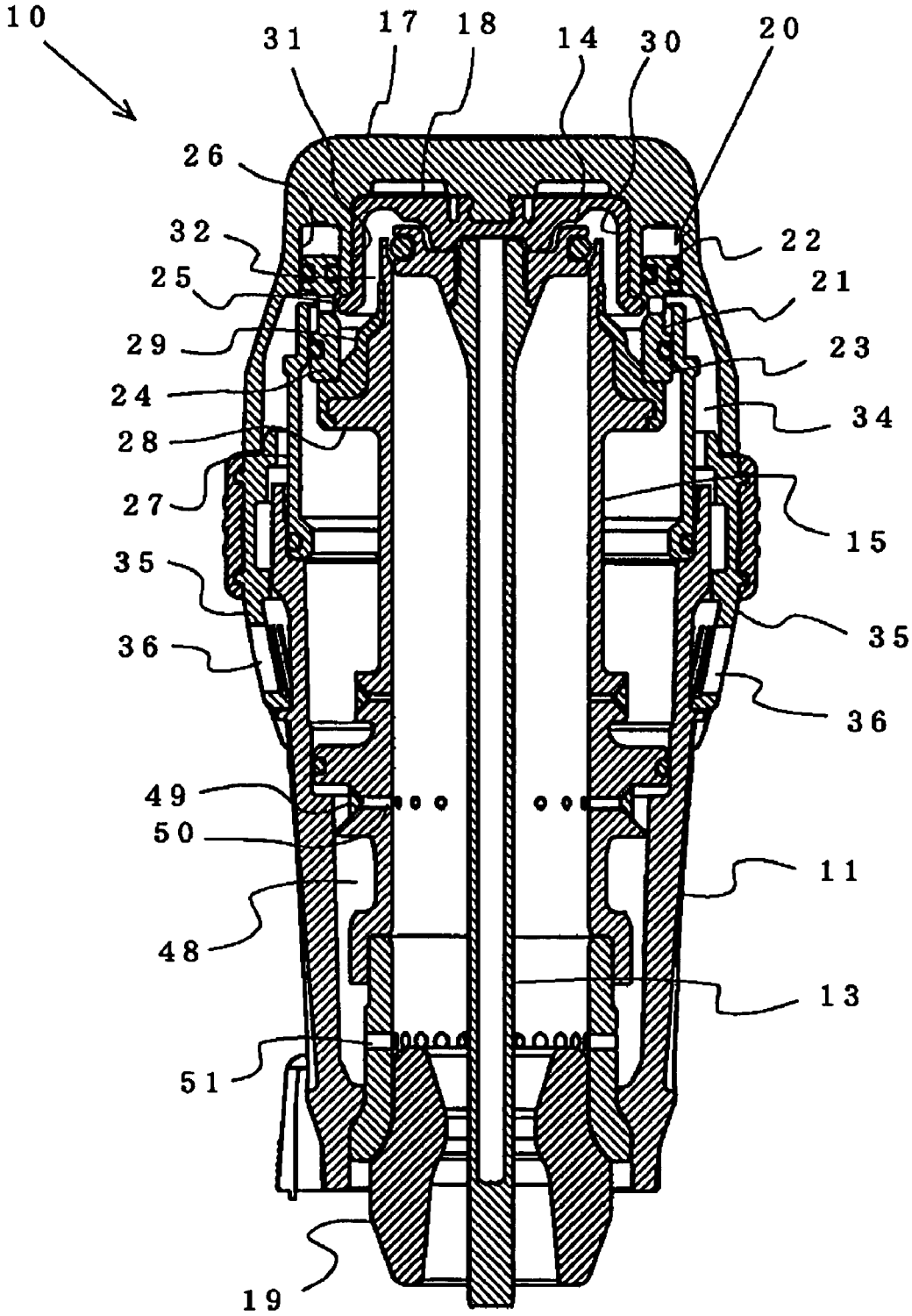
FIG. 2 is a vertical sectional front view showing a compressed air nailing machine the same as that of FIG. 1.

FIG. 1 and FIG. 2 show a portion of an ailing machine embodying a main valve mechanism and driven by compressed air. The nailing machine 10 includes a housing 11 integrally formed with a grip portion 12 for grasping the nailing machine 10. Inside of the housing formed in a hollow shape contains a strike mechanism constituted by a strike piston 14 integrally coupled with a driver 13 for striking a nail on a lower face side thereof, and a strike cylinder 15 slidably containing the strike piston 14. The strike piston 14 is impulsively driven from an upper dead center position to a lower dead center position at inside of the strike cylinder by supplying compressed air to inside of the strike cylinder 15. A nail is struck by way of the driver 13 by driving the strike piston 14.

Inside of the grip portion 12 is formed to be hollow and is always supplied with compressed air by connecting a rear end portion of the grip portion, not illustrated, to a supply source of compressed air by an air hose. The hollow portion of the grip portion 12 is connected to an outer peripheral side of the strike cylinder 15 arranged at inside of the housing 11. An air chamber 16 for storing compressed air for driving the nailing machine 10 is formed at the hollow portion of the grip portion 12 and a surrounding of the strike cylinder 15.

An upper end of the housing 11 containing the strike mechanism is mounted with an upper housing 17 to close an opening portion of the housing 11. A lower face side of the upper housing 17 is arranged with a piston stop 18 for restricting the upper dead center position of the strike piston 14 slidable at inside of the strike cylinder 15. The piston stop 18 is formed by a material having a large heat insulating property and having an elasticity of rubber or the like, and damps the strike piston 14 to stop at the upper dead center position by being engaged with an upper face of the strike piston 14 operated to return to the upper dead center position by compressed air. A lower portion of the strike cylinder 15 is arranged with a bumper 19 to be engaged with a lower face side of the strike piston 14 driven in a lower dead center direction by compressed air at the lower dead center position.

Compressed air stored at inside of the air chamber 16 is supplied to inside of the strike cylinder 15 by way of a gap formed between an upper end edge of the strike cylinder 15 and a lower face of the piston stop 18. An outer periphery of the strike cylinder 15 is formed with a main valve mechanism 20 for communicating and cutting an interval between inside of the strike cylinder 15 and the air chamber 16. The main valve mechanism 20 is constituted as a three way valve and is constituted to communicate/cut the interval between inside of the strike cylinder 15 and the air chamber 16 and communicate/cut an interval between inside of the strike cylinder 15 and the atmosphere.

The main valve mechanism 20 is constituted by a main valve 21 in a ring shape an upper end of which is formed with a ring-shaped piston portion 22 and a lower end of which is formed with a ring-shaped valve member portion 23, an air intake valve seat 24 for communicating and cutting an interval between inside of the strike cylinder 15 and the air chamber 16, and an air exhaust valve seat 25 for communicating and cutting an interval between inside of the strike cylinder 15 and the atmosphere in cooperation with the ring-shaped valve member portion 23 of the main valve 21. According to the main valve 21, the ring-shaped piston portion 22 formed at an upper portion of the main valve 21 is contained at inside of a ring-shaped recess portion 26 formed at an inner face of the housing 17 to direct to a lower side. A lower portion of the main valve 21 is slidably guided along an axial direction of the strike cylinder 15 by being brought into sliding contact with an inner peripheral face of a guide sleeve 27 arranged between an outer peripheral face of the strike cylinder 15 and an inner wall face of the housing 11.

An outer peripheral face remote from an upper end of the strike cylinder 15 in a lower direction is formed with a ring-shaped flange portion 28 to project in a ring shape in a direction of an outer diameter of the strike cylinder 15. A cylinder seal 29 formed by a material having a large heat insulating property and having an elasticity is mounted from a surface of a projected portion of the ring-shaped flange portion 28 over to an outer peripheral face of an upper portion of the strike cylinder 15 to cover the surfaces. The air intake valve seat 24 for communicating and cutting inside of the strike cylinder 15 to and from the air chamber 16 in cooperation with the ring-shaped valve member portion 23 of the main valve 21 is constituted by a portion of the cylinder seal 29 mounted to an upper face of the ring-shaped flange portion 28. A lower end face of the ring-shaped valve member portion 23 communicates and cuts the interval between inside of the strike cylinder 15 and the air chamber 16 by being brought into contact with and separated from the face of the cylinder seal 29 mounted to an upper face of the ring-shaped flange portion 28.

The piston stop 18 mounted to the inner face of the upper housing 17 is formed in a cup-like shape as a whole. An outer peripheral edge portion 30 of the piston stop 18 is arranged along an inner peripheral face of a cylindrical portion 31 formed at the upper housing 17, and formed to be extended to direct in a lower direction while maintaining a predetermined gap from an outer peripheral face of an upper end portion of the strike cylinder 15. A intake/exhaust path 32 for making compressed air flow between the main valve 21 and the strike cylinder 15 is formed between an inner peripheral face of the outer peripheral edge portion 30 of the piston stop 18 and the cylinder seal 29 mounted to the outer peripheral face of the strike cylinder 15. Further, the air exhaust valve seat 25 for opening and closing the interval between inside of the strike cylinder 15 and the atmosphere is formed by bringing a lower end portion of the outer peripheral edge portion 30 of the piston stop 18 into contact with an inner peripheral face of the ring-shaped valve member portion 23 of the main valve 21 and separating the lower end portion therefrom.

The housing 11, and the strike cylinder 15 and the like constituting the nailing machine according to the embodiment is formed by a metal material as a material of a general machine of steel, aluminum alloy, magnesium alloy or the like. On the other hand, as described above, the piston stop 18 and the cylinder seal 29 are formed by an elastomer of rubber or the like. As rubber, for example, urethane rubber, nitrile rubber (NBR), silicone rubber, fluororubber or the like may be listed. That is, the piston stop 18 and the cylinder seal 29 is provided with a heat insulating property larger than that of the housing 11 and the strike cylinder 15 and an elasticity higher than that of the housing 11 and the strike cylinder 15. Further, a material other than rubber can be used as the material of the piston stop 18 and the cylinder seal 29 so far as the material is a material having a large heat insulating property and a high elasticity.

Figure 3:
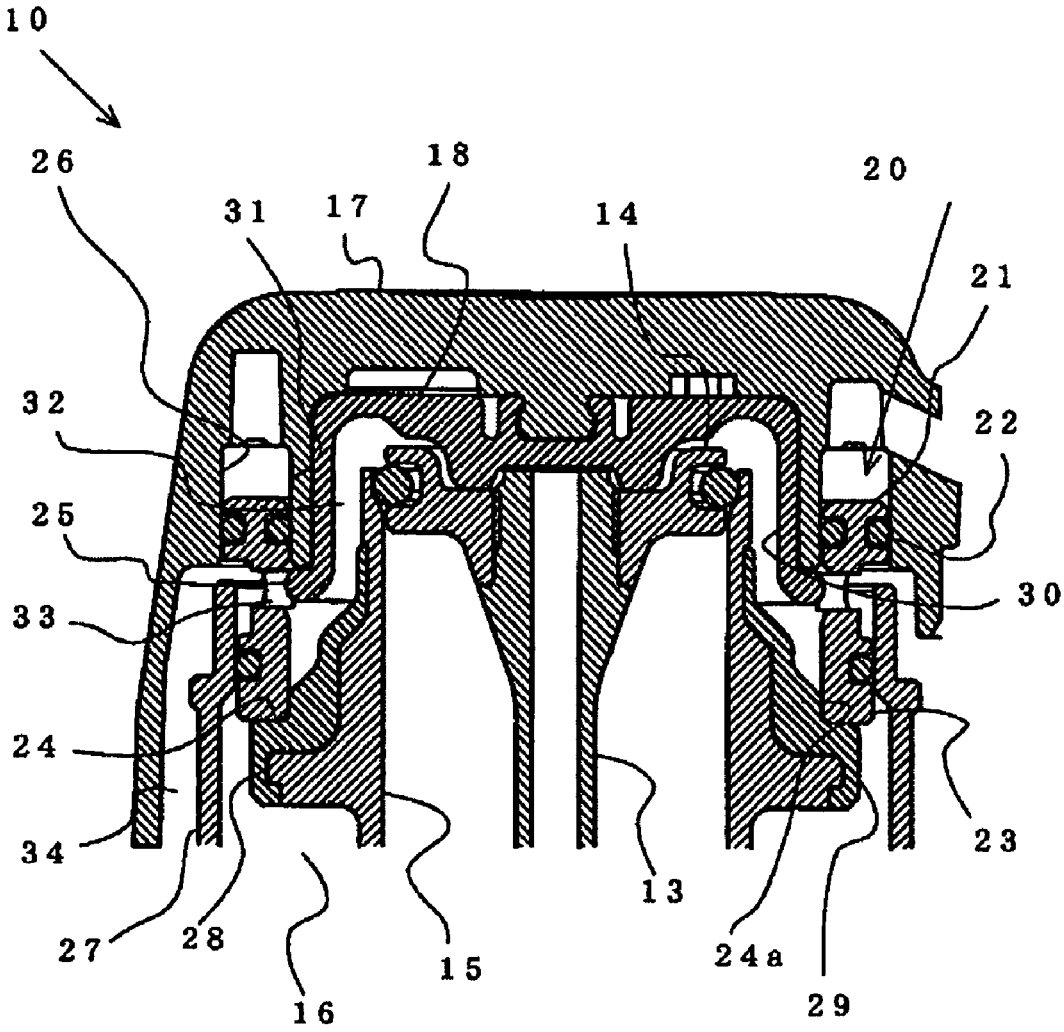
FIG. 3 is an enlarged sectional view enlarging to show an essential portion of FIG. 1.

As shown in FIG. 3 in details, the main valve 21 is formed with an opening 33 for communicating an inner side and an outer side of the main valve 21. In a state in which the main valve 21 is operated in a lower direction and the ring-shaped valve member portion 23 is separated from the air exhaust valve seat 25, inside of the strike cylinder 15 is communicated with an exhaust chamber 34 formed on an outer peripheral side of the guide sleeve 27 by way of the opening 33. As shown by FIG. 2, the exhaust chamber 34 is communicated with the atmosphere by way of an exhaust port 36 formed at an exhaust cover 35 mounted to an outer side of the housing 11. Compressed air at inside of the strike cylinder 15 after driving the strike piston 14 is exhausted to the atmosphere by way of the opening 33, the exhaust chamber 34 and the exhaust port 36.

In a state of cutting the interval between inside of the strike cylinder 15 and the air chamber 16 by bringing the lower end of the ring-shaped valve member portion 23 of the main valve 21 into contact with the upper face of the air intake valve seat 24, an inner peripheral face of the ring-shaped valve member portion 23 is separated from the air exhaust valve seat 25 to communicate inside of the strike cylinder 15 with the exhaust chamber 34 by way of the opening 33. Further, in a state in which the ring-shaped valve member portion 23 of the main valve 21 is separated from the upper face of the air intake valve seat 24 to supply compressed air at inside of the air chamber 16 to inside of the strike cylinder 15, the air exhaust valve seat 25 is brought into sliding contact with the inner peripheral face of the ring-shaped valve member portion 23 to operate to cut inside of the strike cylinder 15 from the exhaust chamber 34.

Further, as shown by FIG. 3, an inner diameter side of the air intake valve seat 24 brought into contact with and separated from the lower end face of the ring-shaped valve member portion 23 is formed with an outer peripheral face 24*a* in a cylindrical shape capable of being brought into sliding contact with the inner peripheral face of the ring-shaped valve member portion 23. Even after the lower end face of the ring-shaped valve member portion 23 is separated from the upper face of the air intake valve seat 24, the inner peripheral face of the ring-shaped valve member portion 23 is brought into sliding contact with the outer peripheral face 24*a* of the air intake valve seat 24 to maintain a state of cutting the interval between inside of the strike cylinder 15 and the air chamber 16. After the main valve 21 is operated further to the upper side and the air exhaust valve seat 25 is brought into sliding contact with the inner peripheral face of the ring-shaped valve member portion 23 to cut inside of the strike cylinder 15 from the exhaust chamber 34, the inner peripheral face of the lower end of the ring-shaped valve member portion 23 is separated from the outer peripheral face 24*a* of the air intake valve seat 24 to communicate between inside of the strike cylinder 15 and the air chamber 16. Thereby, it is prevented that the air intake valve seat 24 and the air exhaust valve seat 25 are simultaneously brought into a state of being separated from the ring-shaped valve member portion 23 and compressed air at inside of the air chamber 16 flows to the side of the exhaust port 36 directly by way of the exhaust chamber 34.

The ring-shaped recess portion 26 formed at the upper housing 17 containing the ring-shaped piston portion 22 formed at the upper end of the main valve 21 is formed as a control chamber. By supplying compressed air to inside of the control chamber 26, the main valve 21 is operated to the lower position of cutting the interval between inside of the strike cylinder 15 and the air chamber 16 by compressed air. By exhausting compressed air from inside of the control chamber 26, the main valve 21 is operated to an upper position of supplying compressed air at inside of the air chamber 16 to inside of the strike cylinder 15 by compressed air operated to the lower end face side of the ring-shaped valve member portion 23. An upper bottom face of the ring-shaped recess portion 26 forming the control chamber 26 is formed at a position lower than an upper end of the piston stop 18 to prevent a total height of the nailing machine from being high by setting an upper end of the main valve 21 when operated to the upper side to be disposed at a position substantially the same as a position of the upper end of the strike cylinder 15.

The nailing machine 10 is provided with a start valve 37 for starting the nailing machine 10 by operating the main valve 21 by supplying compressed air to inside of the control chamber 26 containing the ring-shaped piston portion 22 of the main valve 21 or exhausting compressed air from inside of the control chamber 26, and a trigger mechanism 38 for making the start valve 37 operated by an operator. The start valve 37 is constituted by a hollow pilot valve 41 slidably arranged at inside of a valve housing 40 and formed with a switch valve 39 for selectively connecting inside of the control chamber 26 to inside of the air chamber 16 and inside of the exhaust chamber 34 at one end side thereof, and a valve stem 42 arranged at inside of a hollow space of the pilot valve 41. By operating the valve stem 42, compressed air is supplied and exhausted to and from inside of a valve chamber 43 containing other end side of the pilot valve 41. The main valve 21 is operated by supplying or exhausting compressed air to or from the control chamber 26 by the switch valve 39 formed on the one end side of the pilot valve 41 by pneumatically operating the pilot valve 41 by compressed air at inside of the valve chamber 43.

The trigger mechanism 38 includes a contact arm 44 a lower end side of which is arranged to project in a direction of a front end of a nail strike out port of the nailing machine 10, and a trigger lever 45 arranged at a base portion of the grip portion 12. By the contact lever 46 operated to slide by positioning the nailing machine 10 to a position of striking a struck member, other end side of the contact lever 46 one end side of which is axially attached to the trigger lever 45 is held to the upper side. Further, by operating to pivot the trigger lever 45, the valve stem 42 projected to a lower side from a bottom portion of the valve housing 40 is operated by way of the contact lever 46.

In an initial state, as shown by FIG. 1 through FIG. 3, compressed air at inside of the air chamber 16 is supplied to inside of the valve chamber 43 formed at the valve housing 40 to urge the pilot valve 41 to the upper side by compressed air at inside of the valve chamber 43. The switch valve 39 formed on the one end side of the pilot valve 41 connects an air path 47 communicating with the control chamber 26 of the main valve 21 to the air chamber 16 and cuts the air path 47 from the exhaust chamber 34. Thereby, compressed air is supplied to inside of the control chamber 26, and the main valve 21 is operated in the lower direction by the compressed air to bring the lower end of the ring-shaped valve member portion 23 into contact with the cylinder seal 29 forming the air intake valve seat 24 to cut the interval between inside of the strike cylinder 15 and the air chamber 16. Further, the air exhaust valve seat 25 is separated from the inner peripheral face of the ring-shaped valve member portion 23 to communicate inside of the strike cylinder 15 with the exhaust chamber 34. An upper face side of the strike piston 14 arranged at the upper dead center position at inside of the strike cylinder 15 is communicated with the atmosphere.

Figure 4:
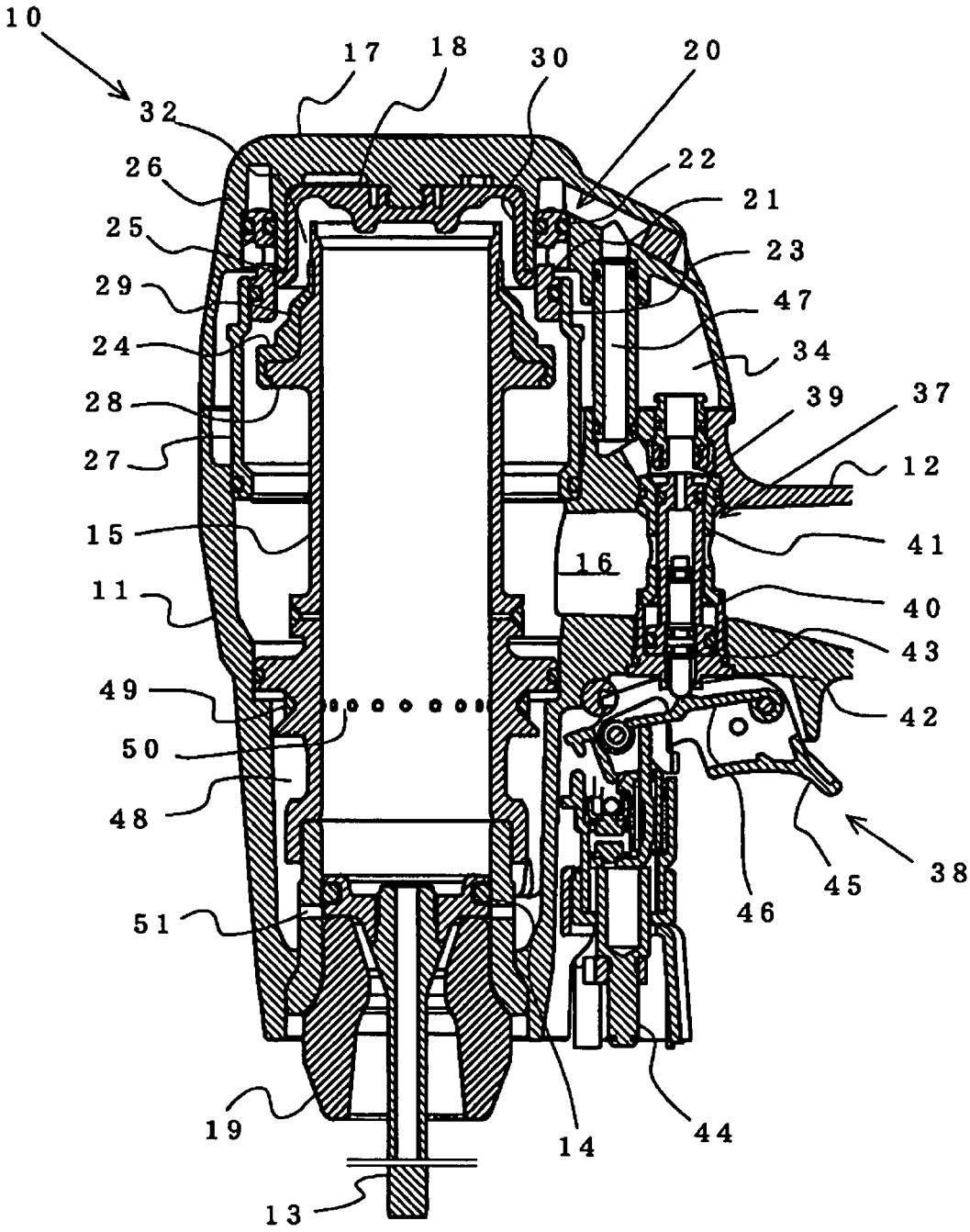
FIG. 4 is a vertical sectional side view of a compressed air nailing machine the same as that of FIG. 1 in a state of operating a main valve mechanism.

Further, when the valve stem 42 is operated by operating to slide the contact arm 44 by positioning an injection port of the nailing machine to the struck member and operating to pivot the trigger lever 45 for starting the nailing machine 10, as shown by FIG. 4, compressed air at inside of the valve chamber 43 formed at inside of the valve housing 40 is exhausted to the atmosphere. Thereby, the pilot valve 41 is operated in the lower direction to cut the interval between the air path 47 and the air chamber 16 by the switch valve 39. Compressed air at inside of the control chamber 26 containing the ring-shaped piston portion 22 of the main valve 21 is exhausted to the exhaust chamber 34 by way of the switch valve 39 by communicating the air path 47 to the exhaust chamber 34.

When compressed air at inside of the control chamber 26 constituted by the ring-shaped recess portion containing the ring-shaped piston portion 22 of the main valve 21 is exhausted to the atmosphere, the main valve 21 is operated to the upper side by compressed air operated to the lower end face side of the main valve 21. The ring-shaped valve member portion 22 of the main valve 21 is separated from the air intake valve seat 24 to communicate inside of the strike cylinder 15 to inside of the air chamber 16 by way of the intake/exhaust path 32. The ring-shaped valve member portion 23 is brought into sliding contact with the air exhaust valve seat 25 to cut the intake/exhaust path 32 from the exhaust chamber 34. Thereby, compressed air at inside of the air chamber 16 is supplied to inside of the strike cylinder 15 instantaneously by way of the intake/exhaust path 32. The strike piston 14 is impulsively driven in the direction of the lower dead center of the strike cylinder 15 by the compressed air. A nail is struck to the struck member by the driver 13 coupled to the strike piston 14.

Further, an outer periphery of the strike cylinder 15 is formed with a returning air chamber 48. A portion of compressed air driving the strike piston 14 by being supplied to inside of the strike cylinder 15 is stored to inside of the returning air chamber 48 by way of an opening 50 mounted with a check valve 49 formed at a peripheral wall of the strike cylinder 15.

When the nailing machine 10 is separated from the struck member after striking the nail to return the contact arm 44 to an unoperated state and the trigger lever 45 is operated to return, the valve stem 42 of the start valve 37 is operated in a lower direction and compressed air is supplied again to inside of the valve chamber 43. Thereby, the pilot valve 41 is operated to the upper side and compressed air is supplied to inside of the control chamber 26 again by the switch valve 39. The main valve 21 is operated in the lower direction by compressed air at inside of the control chamber 26. When the main valve 21 is operated in the lower direction, the lower end face of the ring-shaped valve member portion 23 of the main valve 21 is brought into close contact with the upper face of the air intake valve seat 24 to cut the interval between the intake/exhaust path 32 and inside of the air chamber 16. The air exhaust valve seat 25 formed at the outer peripheral edge portion 30 of the piston stop 18 is brought into sliding contact with the inner peripheral face of the ring-shaped valve member 23 to communicate inside of the strike cylinder 15 to the exhaust chamber 34 by way of the intake/exhaust path 32.

When inside of the strike cylinder 15 is communicated with the exhaust chamber 34 by the main valve 21, compressed air at inside of the strike cylinder 15 driving the strike piston 14 to the lower dead center position is exhausted to the exhaust chamber 34 by way of the intake/exhaust path 32. Compressed air exhausted to inside of the exhaust chamber 34 is exhausted to the atmosphere from the exhaust port 36 formed at the exhaust cover 35. By exhausting compressed air on the upper face side of the strike piston 14 at inside of the strike cylinder 15 to the atmosphere, compressed air stored at inside of the returning air chamber 48 advances to inside of the strike cylinder 15 from an opening 51 formed at a lower portion of the strike cylinder 15. By operating the compressed air to the lower face side of the strike piston 14, the strike piston 14 is operated to return to the initial upper dead center position and is at standby at the upper dead center position for successive driving.

As described above, when compressed air at high pressure stored at inside of the air chamber 16 is supplied to inside of the intake/exhaust path 32 by separating the ring-shaped valve member 23 from the air intake valve seat 24 by operating the main valve 21 to the upper side, compressed air is rapidly expanded, air temperature is lowered by the adiabatic expansion to cool the surfaces of the cylinder seal 29 and the piston stop 18 forming the intake/exhaust path 32. Further, ice particles produced by cooling to freeze water in compressed air are adhered to the surfaces of the cylinder seal 29 and the piston stop 18. However, both of the cylinder seal 29 and the piston stop 18 are formed by a material of rubber or the like having a high heat insulating property and an elasticity. Therefore, even when ice particles are produced in compressed air by a temperature drop by adiabatic expansion, ice particles are difficult to be adhered to rubber having the high heat insulating property and rich in an elastic force. Even when ice particles are adhered thereto, ice particles are easily exfoliated therefrom and therefore, blown off easily by compressed air. Therefore, freezing at inner and outer wall portions of the intake/exhaust path 32 formed by the cylinder seal 29 and the piston stop 18 when the main valve 21 is opened can excellently be prevented. Therefore, a failure in seal or leakage of air are not brought about at the main valve 21 by growth of ice particles, and the main valve mechanism 20 can be operated always excellently.

Although an explanation has been given of the invention in details and in reference to the specific embodiments, it is apparent for the skilled person that the invention can variously be changed or modified without deviating from the spirit and the range of the invention.

The application is based on Japanese Patent application (Japanese Patent Application No. 2004-239893) filed on Aug. 19, 2004 and a content thereof is incorporated herein by reference.

INDUSTRIAL APPLICABILITY

As described above, according to the embodiment of the invention, the ring-shaped flange portion is formed to project from the outer peripheral face remote from the upper end edge of the strike cylinder, the main valve formed in the ring shape is arranged slidably along the outer periphery of the strike cylinder on the upper side of the ring-shaped flange portion, the air intake valve seat is formed at the cylinder seal opposed to the lower end of the main valve, the air exhaust valve seat is formed at the lower end of the outer peripheral edge portion of the piston stop opposed to the inner peripheral face of the main valve and therefore, the total height of the compressed air nailing machine can be formed to be smaller than that of the background art.

Further, the cylinder seal constituted by the material having the large heat insulating property and having the elasticity is mounted from the upper face of the ring-shaped flange portion over to the upper end portion of the strike cylinder to cover the surfaces, the upper side of the strike cylinder is arranged with the piston stop having the large heat insulating property and the elasticity for damping the strike piston at the upper dead center position, the outer peripheral edge portion of the piston stop is arranged to extend in the lower direction along the upper outer peripheral face of the strike cylinder, further, the intake/exhaust path for guiding compressed air from the main valve to the upper end edge of the strike cylinder is formed between the outer peripheral face of the cylinder seal and inner peripheral face of the outer peripheral edge portion of the piston stop and therefore, even when freezing is brought about by water of compressed air by adiabatic expansion of compressed air on a downstream side of the opened main valve, ice particles are difficult to adhere to rubber having the high heat insulating property and rich in the elastic force, even when ice particles are adhered thereto, ice particles are easy to be exfoliated therefrom and therefore, easily blown off by compressed air. Therefore, the intake/exhaust path of compressed air is excellently prevented from being frozen and therefore, a failure in seal or leakage of air of the main valve is not brought about and the head valve can be operated always excellently.

The invention claimed is:

1. A compressed air nailing machine comprising:

a strike piston;

a strike cylinder for slidably containing the strike piston;

an air chamber storing compressed air;

a ring-shaped flange portion formed to project from an outer peripheral face remote from an upper end edge of the strike cylinder;

a main valve formed in a ring shape and slidably arranged on an upper side of the ring-shaped flange portion;

a cylinder seal for covering surfaces of an upper face of the ring-shaped flange portion and an upper end portion of the strike cylinder from the upper face of the ring-shaped flange portion over to the upper end portion of the strike cylinder;

a piston stop including an outer peripheral edge portion arranged on an upper side of the strike cylinder, damping the strike piston at an upper dead center position and formed to extend in a lower direction along an outer peripheral face of an upper portion of the strike cylinder;

an air intake valve seat formed at a position of the cylinder seal opposed to a lower end of the main valve;

an air exhaust valve seat formed at a lower end of the outer peripheral edge portion of the piston stop; and an air intake/exhaust path formed between an outer peripheral face of the cylinder seal and an inner peripheral face of the outer peripheral edge portion of the piston stop for guiding compressed air from the main valve to an upper end edge of the strike cylinder.

2. The compressed air nailing machine according to claim 1, wherein the cylinder seal and the piston stop are formed by a material having a heat insulating property larger than a heat insulating property of a material constituting the strike cylinder and having an elasticity higher than an elasticity of the material of constituting the strike cylinder.

3. The compressed air nailing machine according to claim 1, wherein the cylinder seal and the piston stop are formed by an elastomer.

* * * * *